US008837991B2

(12) United States Patent
Iwata

(10) Patent No.: US 8,837,991 B2
(45) Date of Patent: Sep. 16, 2014

(54) DEVELOPING DEVICE

(71) Applicant: Samsung Electronics Co., Ltd., Suwon-si (KR)

(72) Inventor: Naoya Iwata, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 59 days.

(21) Appl. No.: 13/706,967

(22) Filed: Dec. 6, 2012

(65) Prior Publication Data

US 2013/0149009 A1 Jun. 13, 2013

(30) Foreign Application Priority Data

Dec. 7, 2011 (JP) ..... 2011-268281

(51) Int. Cl.
*G03G 15/08* (2006.01)

(52) U.S. Cl.
USPC ..... 399/254; 399/256

(58) Field of Classification Search
USPC ..... 399/254, 256
See application file for complete search history.

(56) References Cited

U.S. PATENT DOCUMENTS

| | | | | |
|---|---|---|---|---|
| 8,208,837 | B2 * | 6/2012 | Iwamura | 399/254 |
| 8,515,317 | B2 * | 8/2013 | Yoshimoto et al. | 399/254 |

FOREIGN PATENT DOCUMENTS

| | | |
|---|---|---|
| EP | 0819993 A1 | 1/1998 |
| JP | 10-31363 | 2/1998 |
| JP | 2009-25724 | 2/2009 |

* cited by examiner

*Primary Examiner* — Hoang Ngo
(74) *Attorney, Agent, or Firm* — Staas & Halsey LLP

(57) ABSTRACT

A developing device includes spiral wings, a forward double spiral wing, clearance portion, backward double spiral wing, and short lead backward spiral wing installed on the rotational shaft of a stirring and carrying unit. The forward and backward double spiral wings have spiral directions opposite to each other, and together are formed to have an equal lead to the spiral wings. The supplying and carrying unit is disposed above the stirring and carrying unit, and the supplying and carrying unit and the stirring and carrying unit are divided by a partition having a communication portion installed at a position corresponding to the forward and backward double spiral wings.

7 Claims, 4 Drawing Sheets

DEVELOPING DEVICE

CROSS-REFERENCE TO RELATED APPLICATIONS

This application claims the benefit of Japanese Patent Application No. 2011-268281, filed on Dec. 7, 2011, in the Japanese Patent Office, and Korean Patent Application No. 10-2012-0136555, filed on Nov. 28, 2012, in the Korean Intellectual Property Office, the disclosures of which are incorporated herein in their entirety by reference.

BACKGROUND

1. Field

The present disclosure relates to a developing device used in an image forming apparatus using an electrophotographic method.

2. Description of the Related Art

An electrophotographic image forming apparatus, which is employed in a digital copier or printer, forms an electrostatic latent image by exposing to light a surface of a photosensitive drum which is uniformly charged, forms a visualized toner image by developing the electrostatic latent image with a toner, and records an image by transferring the toner image on a recording medium. In such an image forming apparatus, a two-component developer having, for example, a toner and a carrier is used to develop an electrostatic latent image by attaching the toner charged via a developer bearing member to a surface of a photosensitive drum.

In the developing device, for example, a stirring and carrying unit stirring and friction-charging a toner in the developer while carrying the toner, and a supplying and carrying unit supplying the charged toner to a developer bearing member while carrying the charged toner are installed. The stirring and carrying unit and the supplying and carrying unit may be disposed, for example, in a horizontal direction or a vertical direction. In a developing device in which the stirring and carrying unit and the supplying and carrying unit are disposed in a vertical direction, when a developer is carried to an end of the stirring and carrying unit by a carrying screw, the developer is lifted upward by a carrying pressure thereof and thus is carried to the supplying and carrying unit (e.g., see Japanese Patent Publication No. 2009-25724). Also, there is known a technology to lift a developer upward by a magnetic force such that the developer is easily carried between the stirring and carrying unit and the supplying and carrying unit disposed in a vertical direction (e.g., see Japanese Patent Publication No. 10-31363).

For example, in case the supplying and carrying unit is disposed above the stirring and carrying unit, the amount of the developer lifted by a carrying pressure or a magnetic force is not sufficiently secured, so that a large amount of developer may stay within the stirring and carrying unit. Therefore, a sufficient mixing, stirring and the like of the developer may be hindered, thus resulting in a decline in image quality.

SUMMARY

The present disclosure is to smoothly carry a developer between a stirring and carrying unit and a supplying and carrying unit, thus decreasing the amount of the developer staying in the stirring and carrying unit and allowing the developer to be easily, sufficiently mixed and stirred.

Additional aspects and/or advantages will be set forth in part in the description which follows and, in part, will be apparent from the description, or may be learned by practice of the disclosure.

According to an aspect of the present disclosure, there is provided a developing device including: a developer bearing member bearing a developer including a toner and a carrier; a stirring and carrying unit carrying the developer in a first carrying direction while stirring the developer; and a supplying and carrying unit disposed above the stirring and carrying unit to supply the developer carried via a communication portion from the stirring and carrying unit to the developer bearing member while carrying the developer in a second carrying direction opposite to the first carrying direction, wherein the stirring and carrying unit includes: a rotational shaft; a first spiral wing formed on the rotational shaft to carry the developer in the first carrying direction; a second spiral wing positioned on the more downstream side in the first carrying direction than the first spiral wing and formed in a multi-spiral to carry the developer in the first carrying direction; and a third spiral wing positioned on the more downstream side in the first carrying direction than the second spiral wing and formed in a multi-spiral to carry the developer in the second carrying direction, wherein the second and third spiral wings are equal in number of spiral lines and lead, and are also equal in position of adjacent ends in a rotational direction, and the communication portion is installed at a position corresponding to the second and third spiral wings of the stirring and carrying unit.

According to the structure of the developing device, the developer in the stirring and carrying unit is carried to the position of the second and third spiral wings while being stirred by the first spiral wing. Thus, since the second and third spiral wings are opposite in spiral direction, are equal in number of spiral lines (e.g., double spiral form) and lead, and are equal in position of adjacent ends in a rotational direction, the developer is collected toward a center portion between the second and third spiral wings and is then subject to an upward lifting action. In addition, since the second and third spiral wings are formed in a double spiral, the developer is subject to the lifting action several times for one revolution such that the developer is efficiently carried to the supplying and carrying unit via the communication portion. Thus, since the developer is smoothly carried between the stirring and supplying unit and the supplying and carrying unit, stay of the developer in the stirring and carrying unit may be decreased to thus easily obtain a stable flow of the developer. Therefore, a length necessary for a stirring region of the developer may be secured, mixing and stirring performances may be enhanced, and/or the length of the developing device may be easily shortened.

An outer diameter of the second and third spiral wings may be formed to be larger than that of the first spring wing in regions other than a region around the communication portion.

According the to the structure of the second and third spiral wings, a clearance between ends of the second and third spiral wings and the housing is suppressed to be narrowed, and at the same time a distance between the ends of the second and third spiral wings and the supplying and carrying unit is also suppressed to be shortened. Thus, carrying loss is decreased, and lifting force acting on the developer is kept in a high state, thereby easily enhancing the carrying efficiency.

A carrying rate of the developer by the stirring and carrying unit may be set to be faster than that of the developer by the supplying and carrying unit.

According to the carrying rate, flow balance of the developer circulating the stirring and carrying unit and the supplying and carrying unit according to the carriability of the developer by the stirring and carrying unit and the supplying and carrying unit, the amount of the developer supplied to the developer bearing member from the supplying and carrying unit may be easily, properly maintained.

The supplying and carrying unit includes: the supplying and carrying unit include: a rotatable shaft, and a spiral wing formed on the rotatable shaft to carry the developer toward the second carrying direction, wherein a diameter of the rotatable shaft in a portion corresponding to the communication portion in the supplying and carrying unit is set to be smaller than that of the rotatable shaft in other portions.

According to the structure of the supplying and carrying unit, a larger space for receiving the developer pushed and lifted by the second and third spiral wings of the stirring and carrying unit is secured in the supplying and carrying unit, and thus the developer may be smoothly carried.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

Figure 1:
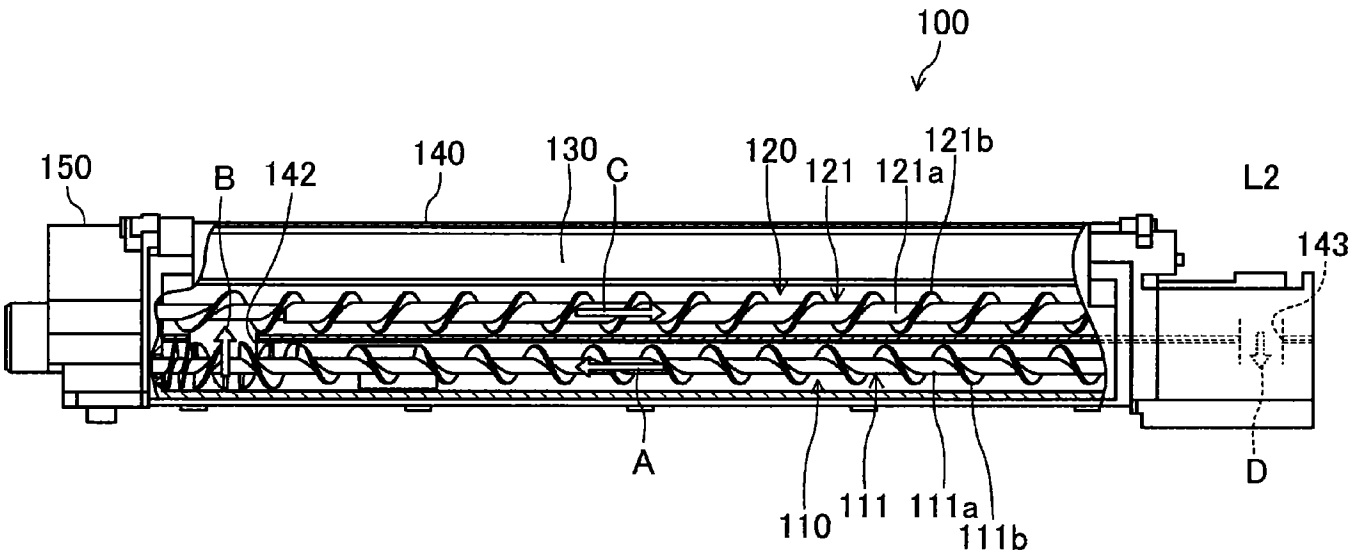
FIG. 1 is a front partial sectional view of a developing device according to an exemplary embodiment of the present disclosure.

The present disclosure will now be described more fully with reference to the accompanying drawings, in which exemplary embodiments of the present disclosure are shown. A developing device is installed in an image forming apparatus, for example, as a developing unit, and forms a toner image by developing an electrostatic latent image formed by an exposure of a photosensitive drum to light with a two-component developer containing a toner and a carrier. The formed toner image is transferred on a recording medium, for example, via a transfer belt, heated and fused. Hereinafter, the developing device will be described in more detail.

(Schematic Configuration of Developing Device 100)

As shown in FIGS. 1 to 4, a developing device 100 is provided with a stirring and carrying unit 110, a supplying and carrying unit 120, and a developing roller (developer bearing member) 130. The stirring and carrying unit 110 is, for example, configured to stir a developer while carrying the developer in the left direction (first carrying direction) (direction of arrow A) in FIG. 1 with a driving force carried via a gear box 150 from an outside of the developing device 100. The supplying and carrying unit 120 is installed just on the stirring and carrying unit 110 to supply the developer carried in an upward direction (direction of arrow B) via a communication portion 142 from the stirring and carrying unit 110 to the developing roller 130 while carrying the developer in the right direction (second carrying direction) (direction of arrow C) in FIG. 1. The developing device 100 is configured to repeat a cycle that a developer remaining after being supplied to the developing roller 130 is carried to an end portion of the supplying and carrying unit 120, moves in a down direction (direction of arrow D) via a communication portion 143, and is again stirred and carried with a toner supplied as required, by the stirring and carrying unit 110.

The developing roller 130 is provided, for example, with a sleeve (not shown) and a magnet installed therein, and is configured that the developer supplied from the supplying and carrying unit 120 is regulated to a predetermined thickness of layer by a developer layer regulating member 160 (see FIGS. 3 and 4), and is then carried around a photosensitive drum (not shown) to develop an electrostatic latent image formed on a surface of a cylinder of the photosensitive drum with a toner in the developer.

(Detailed Configuration of Stirring and Carrying Unit 110 and Supplying and Carrying Unit 120)

The stirring and carrying unit 110 is configured that a first rotational member 111 having a rotational shaft 111*a* is installed in a housing 140 to be rotatable via a bearing 112. Spiral wings (first spiral wing) 111*b* stirring the developer while carrying the developer are installed at a region other than an end portion of a downstream side of the carrying direction of the developer in the rotational shaft 111*a*. A paddle 111*c* for further stirring the developer is partially installed in the spiral wings 111*b*, but an installation position of the paddle 111*c* is not particularly limited.

A forward double spiral wing (second spiral wing) 111*d*, a clearance portion 111*e*, a backward double spiral wing 111*f* (third spiral wing), and a short lead backward spiral wing 111*g* are installed in the named order at the downstream side in the carrying direction of the developer along the spiral wings 111*b* on the rotational shaft 111*a*. Each of the first and second spiral wings 111*d* and 111*f* may be formed in multi-spirals. The first and second spiral wings 111*d* and 111*f* may have the same number of the spiral lines.

The forward double spiral wing 111*d* and the backward double spiral wing 111*f* have spiral directions opposite to each other, and the forward double spiral wing 111*d* and the backward double spiral wing 111*f* together are formed to have an equal lead to the spiral wing 111*b* (i.e., each of the forward double spiral wing 111*d* and the backward double spiral wing 111*f* has a pitch corresponding to half the pitch of the spiral wing 111*b*). Also, the position of rotational direction of adjacent end portions in the forward double spiral wing 111*d* and the backward double spiral wing 111*f* is the same (i.e., the same phase). The length of each of the forward double spiral wing 111*d* and the backward double spiral wing 111*f* is set, for example, to a value of not less than ½ of the lead (pitch) of the spiral wing 111*b*. The length of the clearance portion 111*e* between the forward double spiral wing 111*d* and the backward double spiral wing 111*f* is set, for example, to a value of not less than ¼ and not more than ½ of the lead of the spiral wing 111*b*, more specifically, for example, about 6 mm.

The short lead backward spiral wing 111*g* is installed between the backward double spiral wing 111*f* and the bearing 112, and has a pitch shorter than that of the spiral wing 111*b* such that the developer is not well agglomerated around the bearing 112.

The spiral wings 111*d* and 111*f*, the short lead backward spiral wing 111*g*, and an end portion (e.g., ½ pitch portion) of the spiral wings 111*b* nearby the forward double spiral wing 111*d* are formed in a large diameter part 111*h* having an outer diameter greater than that of the spiral wings 111*b*.

The stirring and carrying unit 110 and the supplying and carrying unit 120 disposed thereon are divided by a partition 141, and at the same time communicate with each other by a communication portion 142 formed at a position corresponding to the spiral wings 111*d* and 111*f*.

Meanwhile, the supplying and carrying unit 120 is configured so that a second rotational member 121 having a rotational shaft 121*a* is installed in the housing 140 to be rotatable via a bearing 122. Spiral wings 121*b* supplying a developer to the developing roller 130 while carrying the developer are installed on the rotational shaft 121*a*. An outer diameter of the rotational shaft 121*a* is set to be larger than that of the rotational shaft 111*a* of the first rotational member 111 such that the carrying speed of the developer by the second rotational member 121 becomes slower than that by the first rotational member 111. The diameter of the rotational shaft 121*a* around the communication portion 142 is set to be smaller than that in other portions such that the developer introduced through the communication portion 142 is carried more easily.

(Operation of Developing Device 100)

In the developing device 100 configured as above, the developer in the stirring and carrying unit 110 is carried in the direction of arrow A in FIG. 1 while being stirred by the spiral wings 111*b*. When the developer is carried to the position of the spiral wings 111*d* and 111*f* having spirals formed in opposite directions to each other, the developer is collected to be narrowed toward the clearance portion 111*e*, so that an upward lifting of the developer occurs. Also, since the spiral wings 111*d* and 111*f* are formed with the double spiral structure, lifting of the developer occurs two times while the rotational shaft 111*a* rotates once, and thus the developer is efficiently carried to the supplying and carrying unit 120 through the communication portion 142.

Further, since the spiral wings 111*d*, 111*f*, the short lead backward spiral wing 111*g*, and an end portion (e.g., ½ pitch portion) of the spiral wings 111*b* nearby the forward double spiral wing 111*d* are formed in a large diameter part 111*h* having a greater outer diameter than most of the spiral wings 111*b*, clearances between ends of the these spiral wings and the housing 140 are suppressed to be narrowed, and at the same time, a distance between the spiral wings 121*b* of the supplying and carrying unit 120 and the spiral wings 111*d* and 111*f*, that is a gap between the ends of the spiral wings 111*d* and 111*f* and the partition 141+ a thickness of the partition 141+ a gap between the partition 141 and the ends of the spiral wings 121*b*, is also suppressed to be shortened, so that carrying loss is decreased, and a lifting force acting on the developer is kept in a high state, thereby easily enhancing the carrying efficiency.

Figure 2:
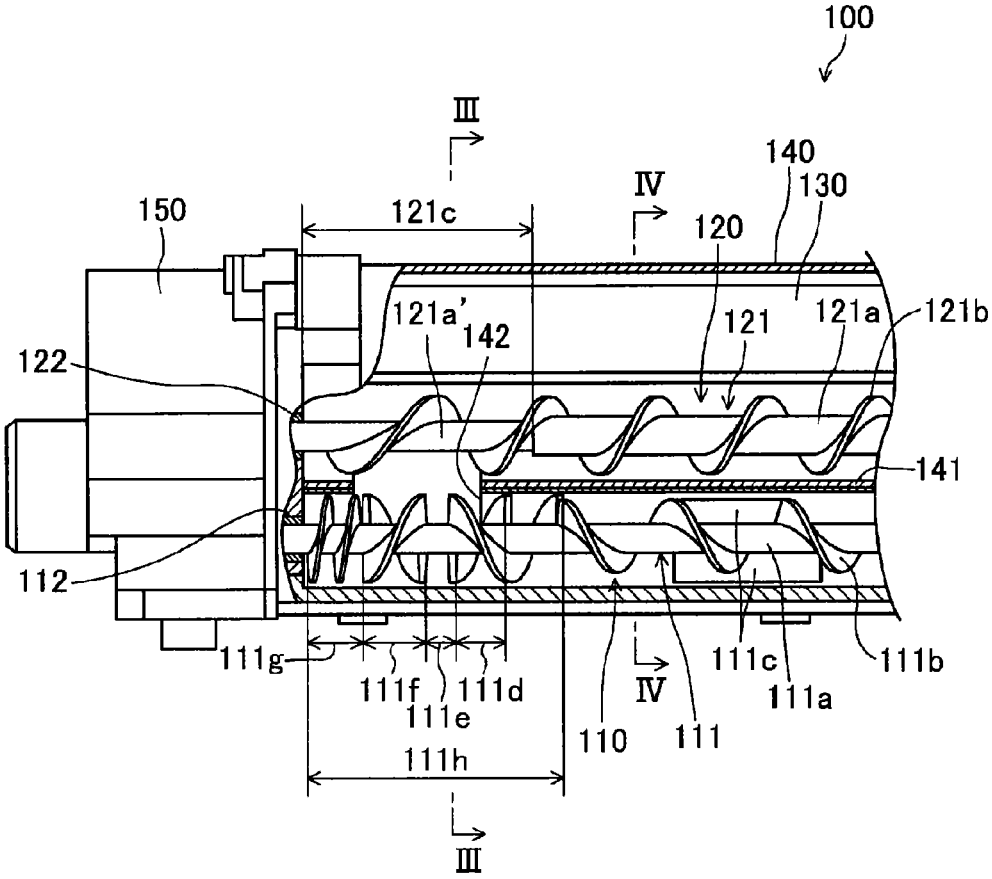
FIG. 2 is a detailed view of a main portion in FIG. 1.
Figure 3:
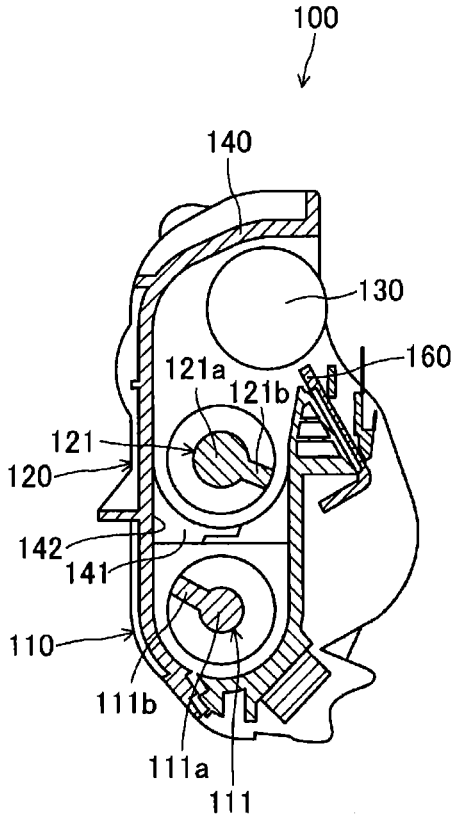
FIG. 3 is a cross-sectional view taken along line III-III of FIG. 2.
Figure 4:
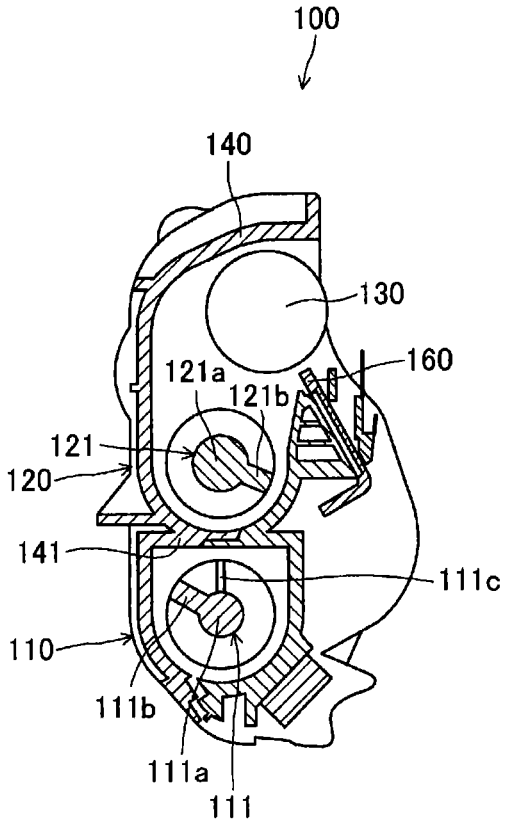
FIG. 4 is a cross-sectional view taken along line IV-IV of FIG. 2.

Also, since the short lead backward spiral wing 111*g* is installed at a position where the communication portion 142 is not formed in the farthest end of the first rotational member 111, the developer around the bearing 112 certainly returns to the right side of FIGS. 1 and 2. Therefore, the degree that the bearing 112 is covered with the developer is decreased, and thus it is easily prevented that the developer penetrates into the bearing 112.

Meanwhile, the developer pushed and lifted by the spiral wings 111*d* and 111*f* of the stirring and carrying unit 110 is carried to the supplying and carrying unit 120 via the communication portion 142. Herein, since a small diameter part 121*a*' is formed around the communication portion 142 on the rotational shaft 121*a* of the supplying and carrying unit 120 to secure a larger space for receiving the developer, the developer may be smoothly carried.

The developer carried to the supplying and carrying unit 120 is carried in the direction of arrow C in FIG. 1 by the spiral wings 121*b* of the second rotational member 121, and some of the developer is supplied to the developing roller 130 during such a carrying of the developer. Since the outer diameter of the rotational shaft 121*a* is set to be larger than that of the rotational shaft 111*a* of the first rotational member 111, the carrying speed of the developer by the second rotational member 121 becomes slower than that by the first rotational member 111. Therefore, flow balance of the developer circulating the stirring and carrying unit 110 and the supplying and carrying unit 120 is properly maintained. In addition, the carrying speed of the developer may be set in consideration of the outer diameter of the rotational shaft as above, or in consideration of the pitch, appearance, rotational speed or any combinations thereof.

The developer carried to the end of the supplying and carrying unit 120 by the supplying and carrying unit 120 repeats a cycle that the developer moves in the direction of arrow D in FIG. 1 via the communication portion 143, is supplied with a new toner when required, is again stirred and carried by the stirring and carrying unit 110.

Since the spiral wings 111*d* and 111*f* are installed around the communication portion 142 via which the developer is carried from the stirring and carrying unit 110 to the supplying and carrying unit 120, the developer may be smoothly carried between the stirring and carrying unit 110 and the supplying and carrying unit 120. For example, even when the length of the communication portion 142 is set to about 20 mm, a stable flow of the developer may be easily obtained by decreasing the stay length of the developer in the stirring and carrying unit 110 to about 45 mm. Also, since the stirring and carrying unit 110 and the supplying and carrying unit 120 are disposed at a lower side and an upper side, the width of the developing device 100 may be decreased, the length necessary for the stirring region of the developer is also secured to enhance the mixing and stirring performances, and/or it is possible to shorten the length of the developing device 100.

Further, since the stay of the developer is decreased, there is no heat generation or friction that may be caused when the bearing 112 is covered with the developer, so that an agglomerate is hardly generated, and decline in printing quality due to adhesion or clogging of such an agglomerate may be easily prevented.

While the present disclosure has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A developing device comprising:

a developer bearing member bearing a developer including a toner and a carrier;

a stirring and carrying unit carrying the developer in a first carrying direction while stirring the developer; and a supplying and carrying unit disposed above the stirring and carrying unit to supply the developer carried via a communication portion from the stirring and carrying unit to the developer bearing member while carrying the developer in a second carrying direction opposite to the first carrying direction, wherein the stirring and carrying unit comprises a rotational shaft;

a first spiral wing formed on the rotational shaft to carry the developer in the first carrying direction;

a second spiral wing positioned on the more downstream side in the first carrying direction than the first spiral wing and formed in a multi-spiral to carry the developer in the first carrying direction; and a third spiral wing positioned on the more downstream side in the first carrying direction than the second spiral wing and formed in a multi-spiral to carry the developer in the second carrying direction, wherein the second and third spiral wings are equal in number of spiral lines and lead, and are also equal in position of adjacent ends in a rotational direction, and the communication portion is installed at a position corresponding to the second and third spiral wings of the stirring and carrying unit.

2. The developing device of claim 1, wherein an outer diameter of the second and third spiral wings is formed to be larger than that of the first spring wing in regions other than a region around the communication portion.

3. The developing device of claim 1, wherein a carrying rate of the developer by the stirring and carrying unit is set to be faster than that of the developer by the supplying and carrying unit.

4. The developing device of claim 1, wherein the supplying and carrying unit comprises:

a rotatable shaft, and a spiral wing formed on the rotatable shaft to carry the developer toward the second carrying direction, wherein a diameter of the rotatable shaft in a portion corresponding to the communication portion in the supplying and carrying unit is set to be smaller than that of the rotatable shaft in other portions.

5. A developing device comprising:

a developer bearing member bearing a developer including a toner and a carrier;

a stirring and carrying unit carrying the developer in a first carrying direction while stirring the developer; and a supplying and carrying unit to supply the developer from the stirring and carrying unit to the developer bearing member while carrying the developer in a second carrying direction opposite to the first carrying direction, wherein the stirring and carrying unit comprises spiral wings, a forward double spiral wing, a clearance portion, a backward double spiral wing, and a short lead backward spiral wing installed on a rotational shaft, and the forward and backward double spiral wings have spiral directions opposite to each other, and together are formed to have an equal lead to the spiral wings.

6. The developing device of claim 5, wherein the supplying and carrying unit is disposed above the stirring and carrying unit.

7. The developing device of claim 5, wherein the supplying and carrying unit and the stirring and carrying unit are divided by a partition having a communication portion installed at a position corresponding to the forward and backward double spiral wings.

* * * * *

UNITED STATES PATENT AND TRADEMARK OFFICE

CERTIFICATE OF CORRECTION

PATENT NO. : 8,837,991 B2
APPLICATION NO. : 13/706967
DATED : September 16, 2014
INVENTOR(S) : Naoya Iwata It is certified that error appears in the above-identified patent and that said Letters Patent is hereby corrected as shown below:

On the Title Page, Column 1, Item [30] (Foreign Application Priority Data), Line 1, after "2011-268281" insert new Line 2, -- Nov. 28, 2012 (KR)..... 10-2012-0136555 --, therefor.

Signed and Sealed this
Twenty-third Day of December, 2014

Michelle K. Lee

Michelle K. Lee
*Deputy Director of the United States Patent and Trademark Office*